US007483832B2

(12) United States Patent
Tischer

(10) Patent No.: US 7,483,832 B2
(45) Date of Patent: Jan. 27, 2009

(54) METHOD AND SYSTEM FOR CUSTOMIZING VOICE TRANSLATION OF TEXT TO SPEECH

(75) Inventor: Steve Tischer, Tucker, GA (US)

(73) Assignee: AT&T Intellectual Property I, L.P., Reno, NV (US)

( * ) Notice: Subject to any disclaimer, the term of this patent is extended or adjusted under 35 U.S.C. 154(b) by 715 days.

(21) Appl. No.: 10/012,946

(22) Filed: Dec. 10, 2001

(65) Prior Publication Data

US 2004/0111271 A1 Jun. 10, 2004

(51) Int. Cl.
*G10L 13/06* (2006.01)
*G10L 13/08* (2006.01)
*G10L 13/00* (2006.01)

(52) U.S. Cl. ..... 704/260; 704/258; 704/266

(58) Field of Classification Search ..... 704/261, 704/266, 260, 258
See application file for complete search history.

(56) References Cited

U.S. PATENT DOCUMENTS 4,624,012 A 11/1986 Lin et al.
4,659,877 A 4/1987 Dorsey et al.
4,685,135 A 8/1987 Lin et al.
4,695,962 A 9/1987 Goudie
4,696,042 A 9/1987 Goudie
4,716,583 A 12/1987 Groner et al.
4,797,930 A 1/1989 Goudie
4,799,261 A 1/1989 Lin et al.
4,802,223 A 1/1989 Lin et al.
4,805,207 A 2/1989 McNutt et al.
4,968,257 A * 11/1990 Yalen ..... 434/308
4,979,216 A 12/1990 Malsheen
5,278,943 A * 1/1994 Gasper et al. ..... 704/200
5,325,462 A 6/1994 Farrett
5,384,701 A 1/1995 Stentiford
5,636,325 A 6/1997 Farrett
5,651,056 A 7/1997 Eting et al.
5,668,926 A 9/1997 Karaali et al.
5,729,694 A 3/1998 Holzrichter et al.
5,765,131 A 6/1998 Stentiford et al.
5,790,978 A 8/1998 Olive et al.
5,864,812 A 1/1999 Kamai et al.
5,873,059 A 2/1999 Iijima et al.
5,903,867 A 5/1999 Watari et al.
5,913,194 A 6/1999 Karaali et al.

(Continued)

OTHER PUBLICATIONS

"AT&T Labs Natural Voices Customized Voice Products," in existence as of Aug. 20, 2001, www.naturalvoices.att.com/products/custom_data.html.

(Continued)

*Primary Examiner*—David R Hudspeth
*Assistant Examiner*—Matthew J Sked
(74) *Attorney, Agent, or Firm*—Scott P. Zimmerman, PLLC

(57) ABSTRACT

A method and system of customizing voice translation of a text to speech includes digitally recording speech samples of a known speaker, correlating each of the speech samples with a standardized audio representation, and organizing the recorded speech samples and correlated audio representations into a collection. The collection of speech samples correlated with audio representations is saved as a single voice file and stored in a device capable of translating the text to speech. The voice file is applied to a translation of text to speech so that the translated speech is customized according to the applied voice file.

21 Claims, 6 Drawing Sheets

U.S. PATENT DOCUMENTS

| | | | | |
|---|---|---|---|---|
| 5,930,755 | A * | 7/1999 | Cecys | 704/260 |
| 5,940,797 | A * | 8/1999 | Abe | 704/260 |
| 5,970,453 | A * | 10/1999 | Sharman | 704/260 |
| 6,035,273 | A * | 3/2000 | Spies | 704/270 |
| 6,041,300 | A * | 3/2000 | Ittycheriah et al. | 704/255 |
| 6,085,160 | A | 7/2000 | D'hoore et al. | |
| 6,151,671 | A | 11/2000 | Pertrushin | |
| 6,161,093 | A | 12/2000 | Watari et al. | |
| 6,175,820 | B1 * | 1/2001 | Dietz | 704/235 |
| 6,185,533 | B1 * | 2/2001 | Holm et al. | 704/267 |
| 6,219,641 | B1 | 4/2001 | Socacin | |
| 6,266,637 | B1 * | 7/2001 | Donovan et al. | 704/258 |
| 6,266,638 | B1 | 7/2001 | Stylianou | |
| 6,269,335 | B1 | 7/2001 | Ittycheriah et al. | |
| 6,269,336 | B1 | 7/2001 | Ladd et al. | |
| 6,275,806 | B1 | 8/2001 | Pertrushin | |
| 6,278,772 | B1 | 8/2001 | Bowater et al. | |
| 6,278,967 | B1 | 8/2001 | Akers et al. | |
| 6,278,968 | B1 | 8/2001 | Franz et al. | |
| 6,278,973 | B1 | 8/2001 | Chung et al. | |
| 6,430,532 | B2 * | 8/2002 | Holzapfel | 704/258 |
| 6,519,479 | B1 | 2/2003 | Garudadri et al. | |
| 6,571,212 | B1 | 5/2003 | Dent | |
| 6,615,172 | B1 | 9/2003 | Bennett et al. | |
| 6,633,846 | B1 | 10/2003 | Bennett et al. | |
| 6,665,640 | B1 | 12/2003 | Bennett et al. | |
| 6,665,641 | B1 * | 12/2003 | Coorman et al. | 704/260 |
| 6,678,659 | B1 | 1/2004 | VanKrommer | |
| 6,681,208 | B2 | 1/2004 | Wu et al. | |
| 6,795,807 | B1 | 9/2004 | Baraff | |
| 6,801,931 | B1 * | 10/2004 | Ramesh et al. | 709/206 |
| 6,804,649 | B2 | 10/2004 | Miranda | |
| 6,823,309 | B1 * | 11/2004 | Kato et al. | 704/267 |
| 6,889,118 | B2 | 5/2005 | Murray, IV et al. | |
| 6,975,988 | B1 * | 12/2005 | Roth et al. | 704/260 |
| 2002/0095289 | A1 * | 7/2002 | Chu et al. | 704/258 |
| 2002/0099547 | A1 * | 7/2002 | Chu et al. | 704/260 |
| 2002/0152073 | A1 * | 10/2002 | DeMoortel et al. | 704/260 |
| 2002/0193994 | A1 * | 12/2002 | Kibre et al. | 704/260 |
| 2002/0193995 | A1 * | 12/2002 | Case et al. | 704/260 |
| 2003/0028380 | A1 * | 2/2003 | Freeland et al. | 704/260 |
| 2003/0061048 | A1 * | 3/2003 | Wu et al. | 704/260 |
| 2003/0130847 | A1 * | 7/2003 | Case | 704/260 |
| 2004/0006471 | A1 * | 1/2004 | Chiu | 704/260 |

OTHER PUBLICATIONS

"AT&T Labs' Natural Voices Product Brochure," in existence as of Aug. 20, 2001, www.naturalvoices.att.com/products/speech.html.

"AT&T Labs Natural Voices Text-to-Speech Engine," in existence as of Aug. 20, 2001, www.naturalvoices.att.com/products/tts_data.html.

Guernsey, L., "Software Called Capable of Copying Any Human Voice," The New York Times, Jul. 31, 2001, www.nytimes.com/2001/07/31/technology/31VOIC.html.

"IBM DirectTalk: IVR and much more," IBM Corporation, Oct. 2000.

"Sounding Human—AT&T's Text Reader Works to Make Machines Sound Human," Aug. 20, 2001, www.msnbc.com/news/615546,asp?0si=-.

"Voice Cloning," Geek News, Aug. 1, 2001, www.geekcom/news/geeknews/2001aug/gee20010801007089.htm.

* cited by examiner

Known Speaker X Recorded Phonemes — 100

| Sample Word (103) | Phoneme (112, 122, 132) |
|---|---|
| odd | AA D |
| at | AE T |
| hut | HH AH T |
| ought | AO T |
| cow | K AW |
| hide | HH AY D |
| be | B IY |
| cheese | CH IY Z |
| dee | D IY |
| thee | DH IY |
| Ed | EH D |
| hurt | HH ER T |
| ate | EY T |
| fee | F IY |
| green | G R IY N |
| he | HH IY |
| it | IH T |
| eat | IY T |
| gee | JH IY |
| key | K IY |
| lee | L IY |
| me | M IY |
| knee | N IY |
| ping | P IH NG |
| oat | OW T |
| toy | T OY |
| pee | P IY |
| read | R IY D |
| sea | S IY |
| she | SH IY |
| tea | T IY |
| theta | TH EY T AH |
| hood | HH UH D |
| two | T UW |
| vee | V IY |
| we | W IY |
| yield | Y IY L D |
| zee | Z IY |
| seizure | S IY ZH ER |

101

140

Text:

"You are one lucky cricket"

Phoneme Translation:

Y UW. AA R . W AH N . L AH K IY.
K R IH K AH T

142

FIG. 4

METHOD AND SYSTEM FOR CUSTOMIZING VOICE TRANSLATION OF TEXT TO SPEECH

FIELD OF THE INVENTION

The present invention relates to computerized voice translation of text to speech. Embodiments of the present invention provide a method and system for customizing a text-to-speech translation by applying a selected voice file of a known speaker to a translation.

BACKGROUND OF THE INVENTION

Speech is an important mechanism for improving access and interaction with digital information via computerized systems. Voice-recognition technology has been in existence for some time and is improving in quality. A type of technology similar to voice-recognition systems is speech-synthesis technology, including "text-to-speech" translation. While there has been much attention and development in the voice-recognition area, mechanical production of speech having characteristics of normal speech from text is not well developed.

In text-to-speech (TTS) engines, samples of a voice are recorded, and then used to interpret text with sounds in the recorded voice sample. However, in speech produced by conventional TTS engines, attributes of normal speech patterns, such as speed, pauses, pitch, and emphasis, are generally not present or consistent with a human voice, and in particular not with a specific voice. As a result, voice synthesis in conventional text-to-speech conversions is typically machine-like. Such mechanical-sounding speech is usually distracting and often of such low quality as to be inefficient and undesirable, if not unusable.

Effective speech production algorithms capable of matching text with normal speech patterns of individuals and producing high fidelity human voice translations consistent with those individual patterns are not conventionally available. Even the best voice-synthesis systems allow little variation in the characteristics of the synthetic voices available for speaking textual content. Moreover, conventional voice-synthesis systems do not allow effective customizing of text-to-speech conversions based on voices of actual, known, recognizable speakers.

Thus, there is a need to provide systems and methods for producing high-quality sound, true-to-life translations of text to speech, and translations having speech characteristics of individual speakers. There is also a need to provide systems and methods for customizing text-to-speech translations based on the voices of actual, known speakers.

Voice synthesis systems often use phonetic units, such as phonemes, phones, or some variation of these units, as a basis to synthesize voices. Phonetics is the branch of linguistics that deals with the sounds of speech and their production, combination, description, and representation by written symbols. In phonetics, the sounds of speech are represented with a set of distinct symbols, each symbol designating a single sound. A phoneme is the smallest phonetic unit in a language that is capable of conveying a distinction in meaning, as the "m" in "mat" and the "b" in "bat" in English. A linguistic phone is a speech sound considered without reference to its status as a phoneme or an allophone (a predictable variant of a phoneme) in a language. (The American Heritage Dictionary of the English Language, Third Edition.)

Text-to-speech translations typically use pronouncing dictionaries to identify phonetic units, such as phonemes. As an example, for the text "How is it going?", a pronouncing dictionary indicates that the phonetic sound for the "H" in "How" is "huh." The "huh" sound is a phoneme. One difficulty with text-to-speech translation is that there are a number of ways to say "How is it going?" with variations in speech attributes such as speed, pauses, pitch, and emphasis, for example.

One of the disadvantages of conventional text-to-speech conversion systems is that such technology does not effectively integrate phonetic elements of a voice with other speech characteristics. Thus, currently available text-to-speech products do not produce true-to-life translations based on phonetic, as well as other speech characteristics, of a known voice. For example, the IBM voice-synthesis engine "DirectTalk" is capable of "speaking" content from the Internet using stock, mechanically-synthesized voices of one male or one female, depending on content tags the engine encounters in the markup language, for example HTML. The IBM engine does not allow a user to select from among known voices. The AT&T "Natural Voices" TTS product provides an improved quality of speech converted from text, but allows choosing only between two male voices and one female voice. In addition, the AT&T "Natural Voices" product is very expensive. Thus, there is a need to provide systems and methods for customizing text-to-speech translations based on speech samples including, for example, phonetic, and other speech characteristics such as speed, pauses, pitch, and emphasis, of a selected known voice.

Although conventional TTS systems do not allow users to customize translations with known voices, other communication formats use customizable means of expression. For example, print fonts store characters, glyphs, and other linguistic communication tools in a standardized machine-readable matrix format that allow changing styles for printed characters. As another example, music systems based on a Musical Instrument Digital Interface (MIDI) format allow collections of sounds for specific instruments to be stored by numbers based on the standard piano keyboard. MIDI-type systems allow music to be played with the sounds of different musical instruments by applying files for selected instruments. Both print fonts and MIDI files can be distributed from one device to another for use in multiple devices.

However, conventional TTS systems do not provide for records, or files, of multiple voices to be distributed for use in different devices. Thus, there is a need to provide systems and methods that allow voice files to be easily created, stored, and used for customizing translation of text to speech based on the voices of actual, known speakers. There is also a need for such systems and methods based on phonetic or other methods of dividing speech, that include other speech characteristics of individual speakers, and that can be readily distributed.

SUMMARY OF THE INVENTION

The present invention provides a method and system of customizing voice translation of a text to speech, including digitally recording speech samples of a specific known speaker and correlating each of the speech samples with a standardized audio representation. The recorded speech samples and correlated audio representations are organized into a collection and saved as a single voice file. The voice file is stored in a device capable of translating text to speech, such as a text-to-speech translation engine. The voice file is then applied to a translation by the device to customize the translation using the applied voice file.

In other embodiments, such a method further includes recording speech samples of a plurality of specific known speakers and organizing the speech samples and correlated audio representations for each of the plurality of known speakers into a separate collection, each of which is saved as a single voice file. One of the voice files is selected and applied to a translation to customize the text-to-speech translation. Speech samples can include samples of speech speed, emphasis, rhythm, pitch, and pausing of each of the plurality of known speakers.

Embodiments of the present invention include combining voice files to create a new voice file and storing the new voice file in a device capable of translating text to speech.

In other embodiments, the present invention further comprises distributing voice files to other devices capable of translating text to speech.

In embodiments of a method and system of the present invention, standardized audio representations comprise phonemes. Phonemes can be labeled, or classified, with a standardized identifier such as a unique number. A voice file comprising phonemes can include a particular sequence of unique numbers. In other embodiments, standardized audio representations comprise other systems and/or means for dividing, classifying, and organizing voice components.

In embodiments, the text translated to speech is content accessed in a computer network, such as an electronic mail message. In other embodiments, the text translated to speech comprises text communicated through a telecommunications system.

Features of a method and system for customizing voice translations of text to speech of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A method and system for customizing voice translations of the present invention provide numerous advantages over prior approaches. For example, the present invention advantageously provides customized voice translation of machine-read text based on voices of specific, actual, known speakers.

Another advantage is that the present invention provides recording, organizing, and saving voice samples of a speaker into a voice file that can be selectively applied to a translation.

Another advantage is that the present invention provides a standardized means of identifying and organizing individual voice samples into voice files. Such a method and system utilize standardized audio representations, such as phonemes, to create more natural and intelligible text-to-speech translations.

The present invention provides the advantage of distributing voice files of actual speakers to other devices and locations for customizing text-to-speech translations with recognizable voices.

The present invention provides the advantage of allowing persons to listen to more natural and intelligible translations using recognizable voices, which will facilitate listening with greater clarity and for longer periods without fatigue or becoming annoyed.

Another advantage is that voice files of the present invention can be used in a wide range of applications. For example, voice files can be used to customize translation of content accessed in a computer network, such as an electronic mail message, and text communicated through a telecommunications system. Methods and systems of the present invention can be applied to almost any business or consumer application, product, device, or system, including software that reads digital files aloud, automated voice interfaces, in educational contexts, and in radio and television advertising.

Another advantage is that voice files of the present invention can be used to customize text-to-speech translations in a variety of computing platforms, ranging from computer network servers to handheld devices.

As will be realized by those of skill in the art, many different embodiments of a method and system for customizing translation of text to speech according to the present invention are possible. Additional uses, objects, advantages, and novel features of the invention are set forth in the detailed description that follows and will become more apparent to those skilled in the art upon examination of the following or by practice of the invention.

BRIEF DESCRIPTION OF THE DRAWINGS

FIG. 4 is a diagram illustrating phonemes recorded for a voice sample and application of the recorded phonemes to a translation of text to speech in an embodiment of the present invention.

DETAILED DESCRIPTION

Embodiments of the present invention comprise methods and systems for customizing voice translation of text to speech. FIGS. 1-6 show various aspects of embodiments of the present invention.

Figure 1:
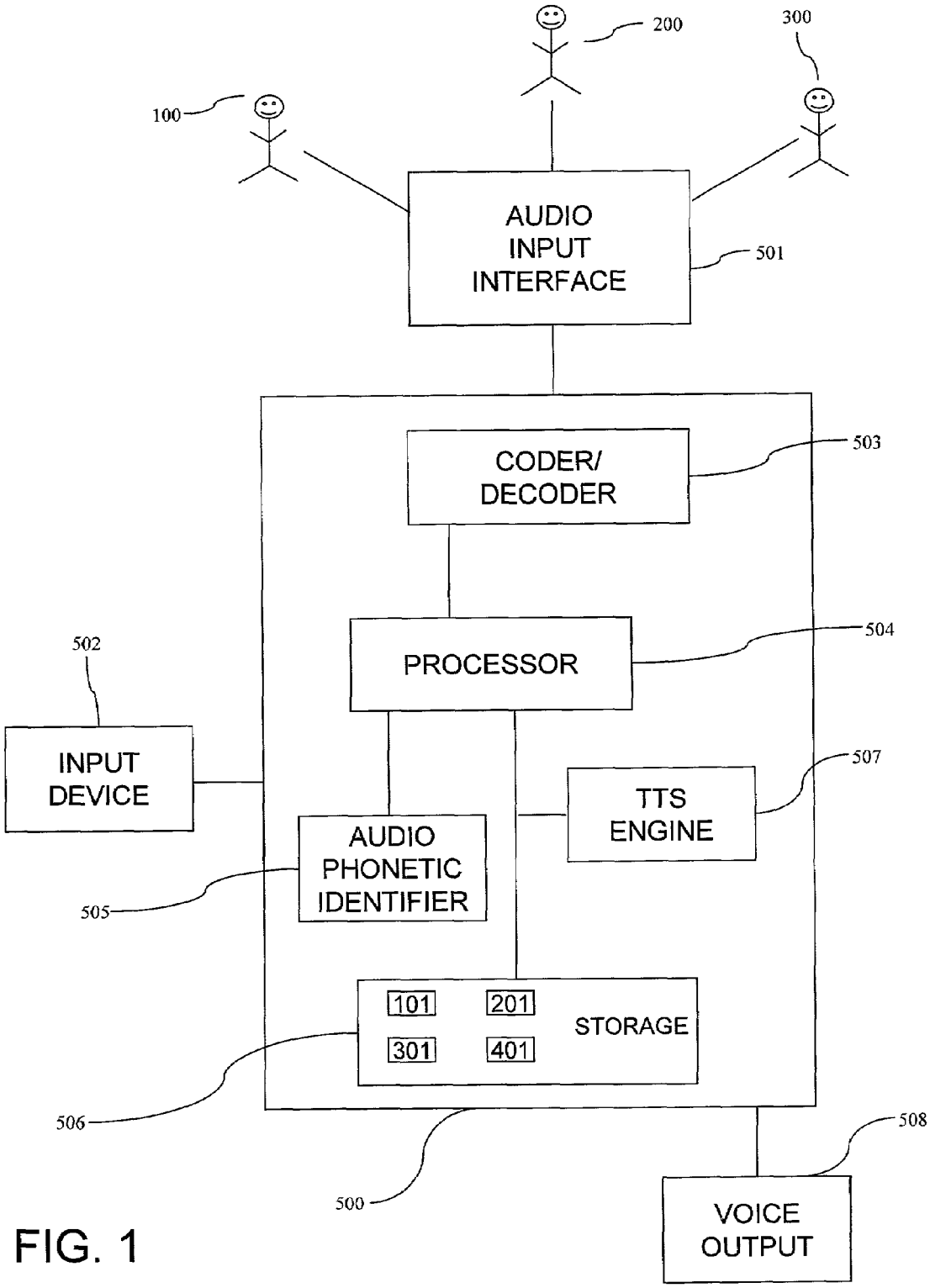
FIG. 1 is a diagram of a text-to-speech translation voice customization system in an embodiment of the present invention.
Figure 5:
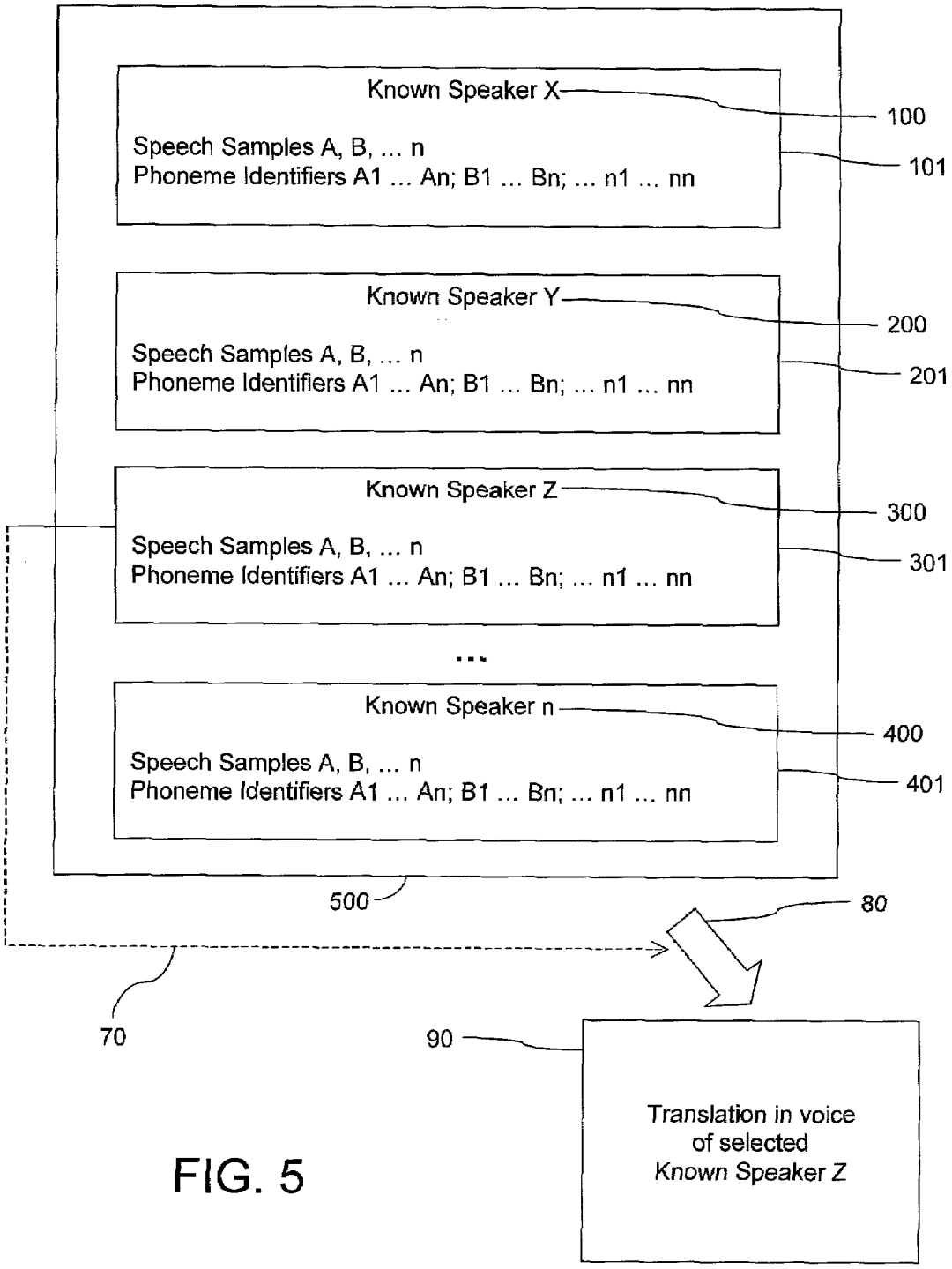
FIG. 5 is a diagram illustrating voice files of a plurality of known speakers stored in a text-to-speech translation device in an embodiment of a text-to-speech translation voice customization system of the present invention.
Figure 6:
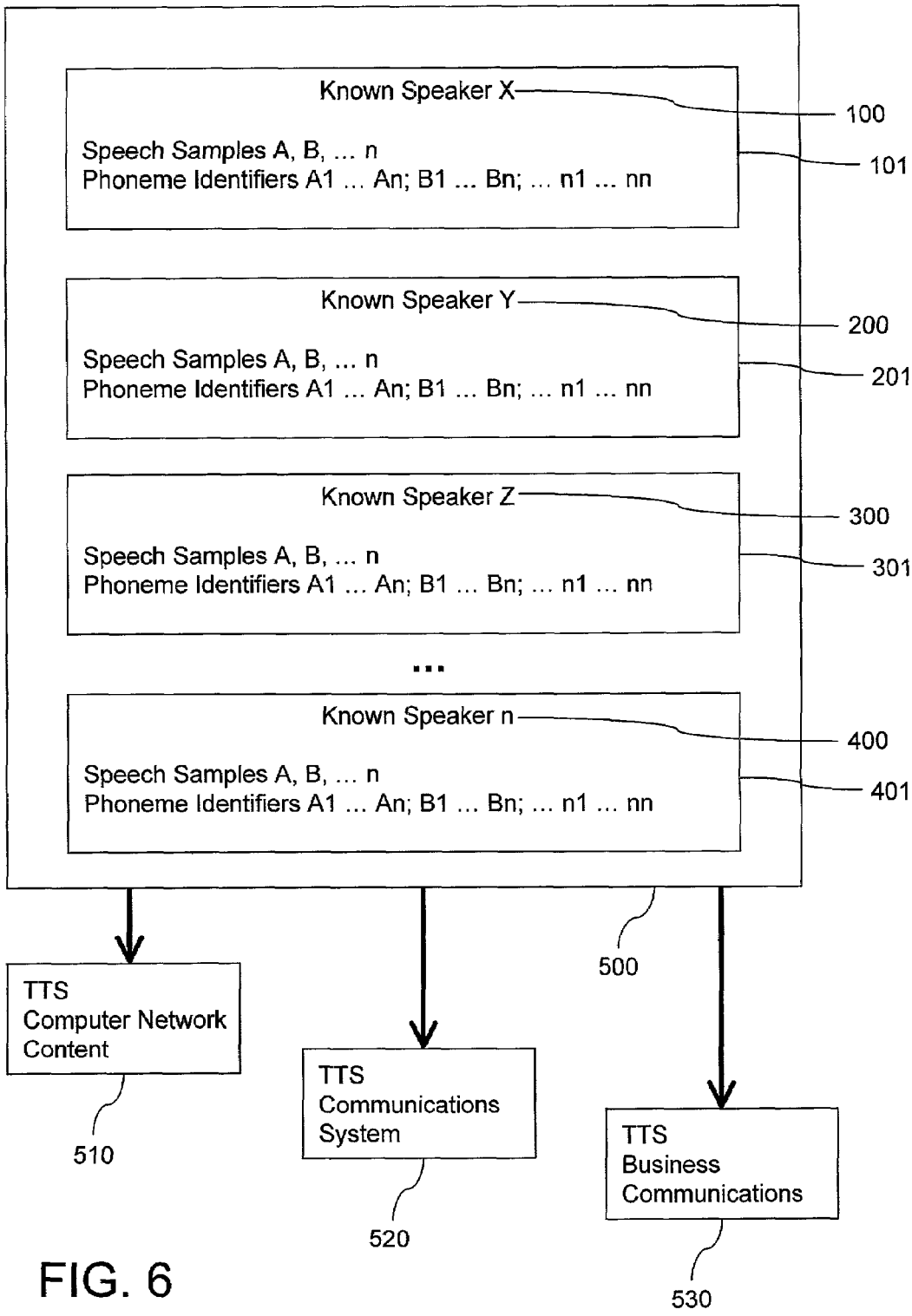
FIG. 6 is a diagram of the text-to-speech translation device shown in FIG. 4 showing distribution of voice files to other devices and use of voice files in text-to-speech translations in various applications in an embodiment of the present invention.

FIG. 1 shows one embodiment of a text-to-speech translation voice customization system. Referring to FIG. 1, the known speakers X (100), Y (200), and Z (300) provide speech samples via the audio input interface 501 to the text-to-speech translation device 500. The speech samples are processed through the coder/decoder, or codec 503, that converts analog voice signals to digital formats using conventional speech processing techniques. An example of such speech processing techniques is perceptual coding, such as digital audio coding, which enhances sound quality while permitting audio data to be transmitted at lower transmission rates. In the translation device 500, the audio phonetic identifier 505 identifies phonetic elements of the speech samples and correlates the phonetic elements with standardized audio representations. The phonetic elements of speech sample sounds and their correlated audio representations are stored as voice files in the storage space 506 of translation device 500. In FIG. 1, as also shown in FIGS. 5 and 6, the voice file 101 of known speaker X (100), the voice file 201 of known speaker Y (200), the voice file 301 of known speaker Z (300), and the voice file 401 of known speaker "n" (not shown in FIG. 1) is each stored in storage space 506. In the translation device 500, the text-to-speech engine 507 translates a text to speech utilizing one of the voice files 101, 201, 301, and 401, to produce a spoken text in the selected voice using voice output device 508. Operation of these components in the translation device 500 is processed through processor 504 and manipulated with external input device 502, such as a keyboard.

Figure 2:
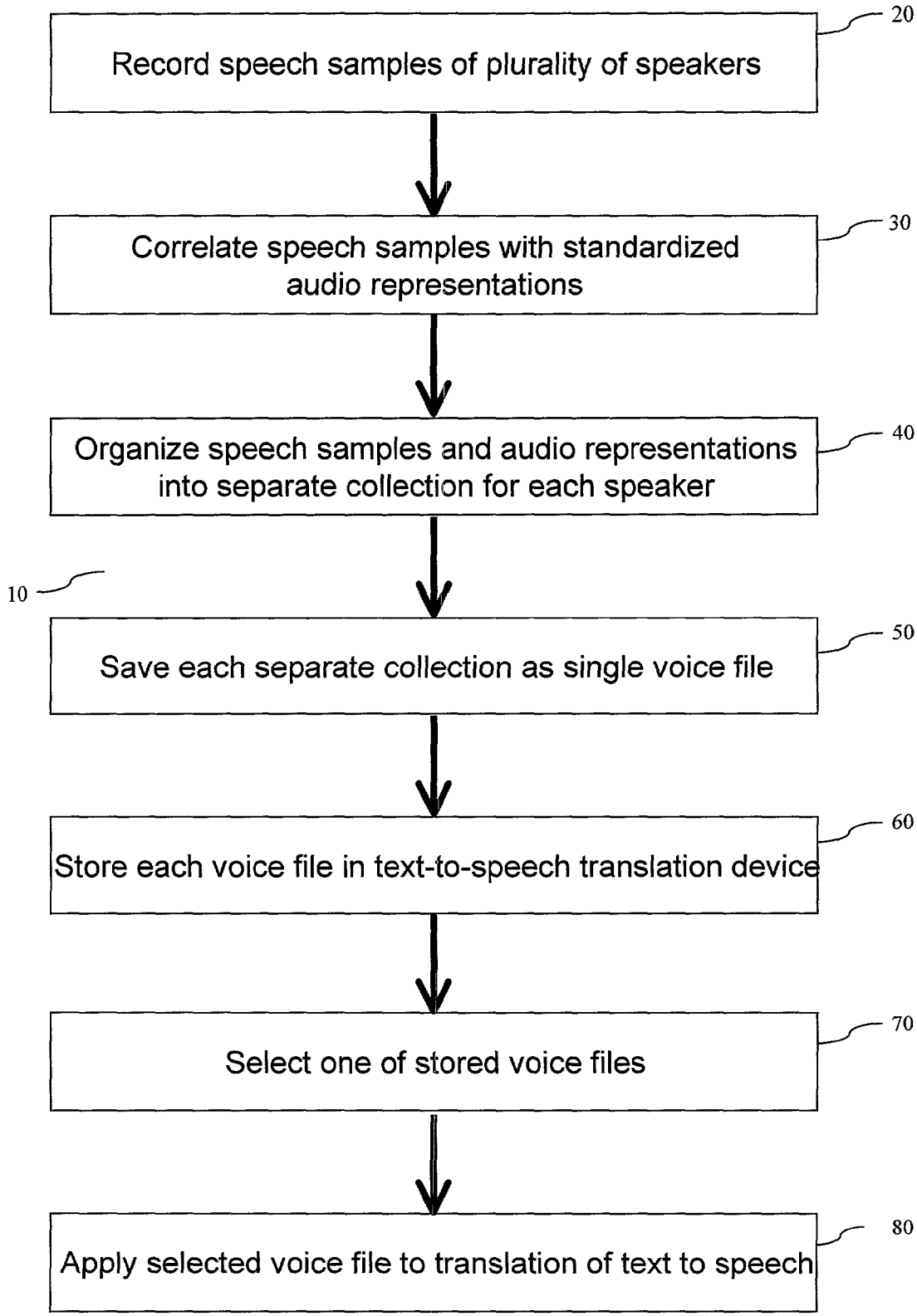
FIG. 2 is a flow chart of a method for customizing voice translation of text to speech in an embodiment of the present invention.

Other embodiments comprise a method for customizing voice translations of text to speech that allows translation of a text with a voice file of a specific known speaker. FIG. 2 shows one such embodiment. Referring to FIG. 2, a method 10 for customizing text-to-speech voice translations according to the present invention is shown. The method 10 includes recording speech samples of a plurality of speakers (20), for example using the audio input interface 501 shown in FIG. 1. The method 10 further includes correlating the speech samples with standardized audio representations (30), which can be accomplished with audio phonetic identification software such as the audio phonetic identifier 505. The speech samples and correlated audio representations are organized into a separate collection for each speaker (40). The separate collection of speech samples and audio representations for each speaker is saved (50) as a single voice file. Each voice file is stored (60) in a text-to-speech (TTS) translation device, for example in the storage space 506 in TTS translation device 500. A TTS device may have any number of voice files stored for use in translating speech to text. A user of the TTS device selects (70) one of the stored voice files and applies (80) the selected voice file to a translation of text to speech using a TTS engine, such as TTS engine 507. In this manner, a text is translated to speech using the voice and speech patterns and attributes of a known speaker. In other embodiments, selection of a voice file for application to a particular translation is controlled by a signal associated with transmitted content to be translated. If the voice file requested is not resident in the receiving device, the receiving device can then request transmission of the selected voice file from the source transmitting the content. Alternatively, content can be transmitted with preferences for voice files, from which a receiving device would select from among voice files resident in the receiving device.

In embodiments of the present invention, a voice file comprises distinct sounds from speech samples of a specific known speaker. Distinct sounds derived from speech samples from the speaker are correlated with particular auditory representations, such as phonetic symbols. The auditory representations can be standardized phonemes, the smallest phonetic units capable of conveying a distinction in meaning. Alternatively, auditory representations include linguistic phones, such as diphones, triphones, and tetraphones, or other linguistic units or sequences. In addition to phonetic-based systems, the present invention can be based on any system which divides sounds of speech into classifiable components. Auditory representations are further classified by assigning a standardized identifier to each of the auditory representations. Identifiers may be existing phoneme nomenclature or any means for identifying particular sounds. Preferably, each identifier is a unique number. Unique number identifiers, each identifier representing a distinct sound, are concatenated, or connected together in a series to form a sequence.

As shown in the embodiment in FIG. 2, sounds from speech samples and correlated audio representations are organized (40) into a collection and saved (50) as a single voice file for a speaker. Voice files of the present invention comprise various formats, or structures. For example, a voice file can be stored as a matrix organized into a number of locations each inhabited by a unique voice sample, or linguistic representation. A voice file can also be stored as an array of voice samples. In a voice file, speech samples comprise sample sounds spoken by a particular speaker. In embodiments, speech samples include sample words spoken, or read aloud, by the speaker from a pronouncing dictionary. Sample words in a pronouncing dictionary are correlated with standardized phonetic units, such as phonemes. Samples of words spoken from a pronouncing dictionary contain a range of distinct phonetic units representative of sounds comprising most spoken words in a vocabulary. Samples of words read from such standardized sources provide representative samples of a speaker's natural intonations, inflections, pitch, accent, emphasis, speed, rhythm, pausing, and emotions such as happiness and anger.

Figure 3:
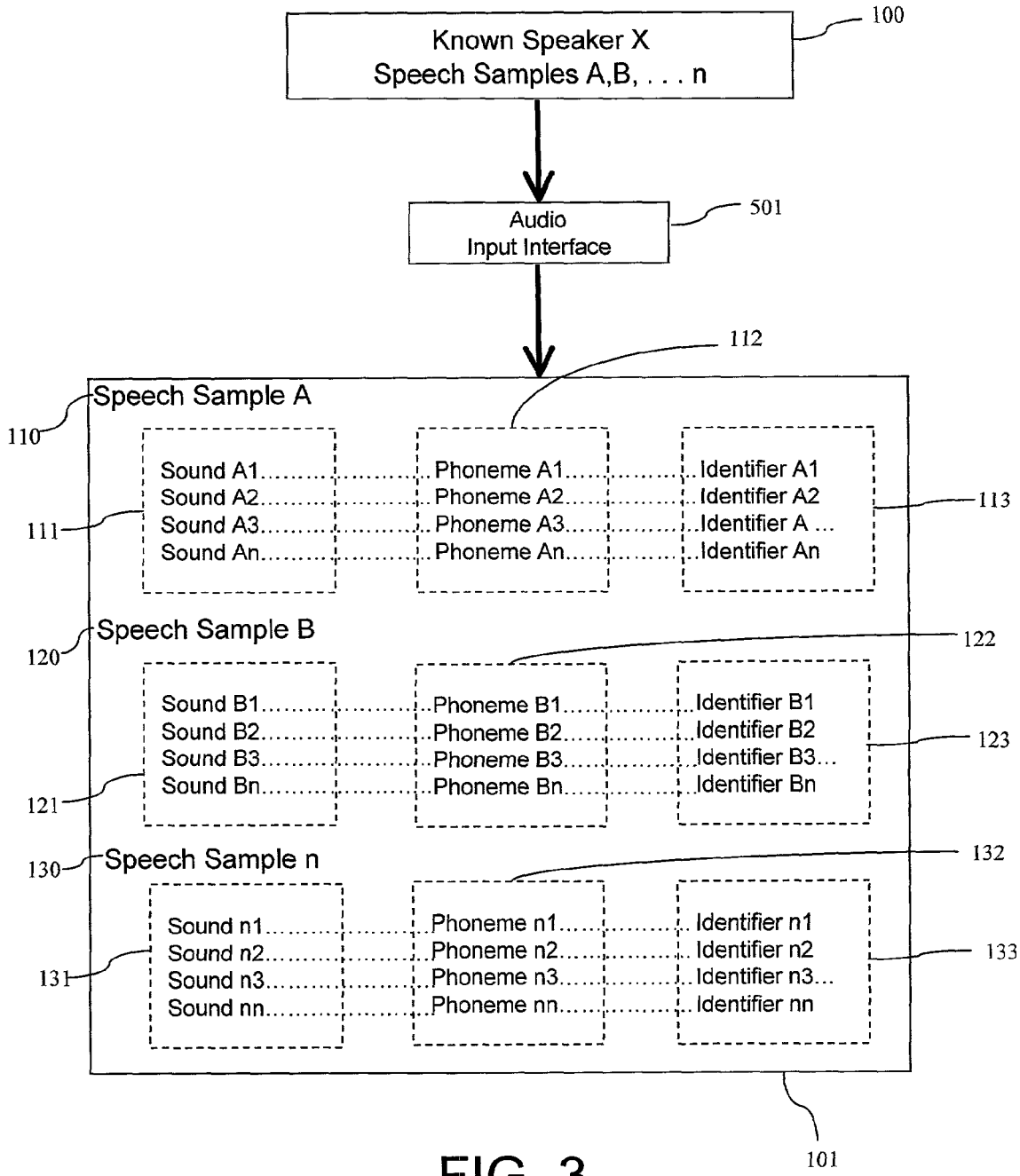
FIG. 3 is a diagram illustrating components of a voice file in an embodiment of the present invention.

As an example, FIG. 3 shows a voice file 101. The voice file 101 comprises speech samples A, B, . . . n of known speaker X (100). Speech samples A, B, . . . n are recorded using a conventional audio input interface 501. Speech sample A (110) comprises sounds A1, A2, A3, . . . An (111), which are recorded from sample words read by speaker X (100) from a pronouncing dictionary. Sounds A1, A2, A3. An (111) are correlated with phonemes A1, A2, A3, . . . An (112), respectively. Each of phonemes A1, A2, A3, . . . An (112) is further assigned a standardized identifier A1, A2, A3, . . . An (113), respectively.

In embodiments, a single voice file comprises speech samples using different linguistic systems. For example, a voice file can include samples of an individual's speech in which the linguistic components are phonemes, samples based on triphones, and samples based on other linguistic components. Speech samples of each type of linguistic component are stored together in a file, for example, in one section of a matrix.

The number of speech samples recorded is sufficient to build a file capable of providing a natural-sounding translation of text. Generally, samples are recorded to identify a pre-determined number of phonemes. For example, 39 standard phonemes in the Carnegie Mellon University Pronouncing Dictionary allow combinations that form most words in the English language. However, the number of speech samples recorded to provide a natural-sounding translation varies between individuals, depending upon a number of lexical and linguistic variables. For purposes of illustration, a finite but variable number of speech samples is represented with the designation "A, B, . . . n", and a finite but variable number of audio representations within speech samples is represented with the designation "1, 2, 3, . . . n."

Similar to speech sample A (110) in FIG. 3, speech sample B (120) includes sounds B1, B2, B3, . . . Bn (121), which include samples of the natural intonations, inflections, pitch, accent, emphasis, speed, rhythm, and pausing of speaker X (100). Sounds B1, B2, B3, . . . Bn (121) are correlated with phonemes B1, B2, B3, . . . Bn (122), respectively, which are in turn assigned a standardized identifier B1, B2, B3, . . . Bn (123), respectively. Each speech sample recorded for known speaker X (120) comprises sounds, which are correlated with phonemes, and each phoneme is further classified with a standardized identifier similar to that described for speech samples A (110) and B (120). Finally, speech sample n (130) includes sounds n1, n2, n3, . . . nn (131), which are correlated with phonemes n1, n2, n3, . . . nn (132), respectively, which are in turn assigned a standardized identifier n1, n2, n3, . . . nn (133), respectively. The collection of recorded speech samples A, B, . . . n (110, 120, 130) having sounds (111, 121, 131) and correlated phonemes (112, 122, 132) and identifiers (113, 123, 133) comprise the voice file 101 for known speaker X (100).

In embodiments of the present invention, a voice file having distinct sounds, auditory representations, and identifiers for a particular known speaker comprises a "voice font." Such a voice file, or font, is similar to a print font used in a word processor. A print font is a complete set of type of one size and face, or a consistent typeface design and size across all characters in a group. A word processor print font is a file in which a sequence of numbers represents a particular typeface design and size for print characters. Print font files often utilize a matrix having, for example 256 or 64,000, locations to store a unique sequence of numbers representing the font.

In operation, a print font file is transmitted along with a document, and instantiates the transmitted print characters. Instantiation is a process by which a more defined version of some object is produced by replacing variables with values, such as producing a particular object from its class template in object-oriented programming. In an electronically transmitted print document, a print font file instantiates, or creates an instance of, the print characters when the document is displayed or printed.

For example, a print document transmitted in the Times New Roman font has associated with it the print font file having a sequence of numbers representing the Times New Roman font. When the document is opened, the associated print font file instantiates the characters in the document in the Times New Roman font. A desirable feature of a print font file associated with a set of print characters is that it can be easily changed. For example, if it is desired to display and/or print a set of characters, or an entire document, saved in Times New Roman font, the font can be changed merely by selecting another font, for example the Arial font. Similar to a print font in a word processor, for a "voice font," sounds of a known speaker are recorded and saved in a voice font file. A voice font file for a speaker can then be selected and applied to a translation of text to speech to instantiate the translated speech in the voice of that particular speaker.

Voice files of the present invention can be named in a standardized fashion similar to naming conventions utilized with other types of digital files. For example, a voice file for known speaker X could be identified as VoiceFileX.vof, voice file for known speaker Y as VoiceFileY.vof, and voice file for known speaker Z as VoiceFileZ.vof. By labeling voice files in such a standardized manner, voice files can be shared with reliability between applications and devices. A standardized voice file naming convention allows lees than an entire voice file to be transmitted from one device to another. Since one device or program would recognize that a particular voice file was resident on another device by the name of the file, only a subset of the voice file would need to be transmitted to the other device in order for the receiving device to apply the voice file to a text translation. In addition, voice files of the present invention can be expressed in a World Wide Web Consortium-compliant extensible syntax, for example in a standard mark-up language file such as XML. A voice file structure could comprise a standard XML file having locations at which speech samples are stored. For example, in embodiments, "VoiceFileX.vof" transmitted via a markup language would include "markup" indicating that text by individual X would be translated using VoiceFileX.vof.

In embodiments of the present invention, auditory representations of separate sounds in digitally-recorded speech samples are assigned unique number identifiers. A sequence of such numbers stored in specific locations in an electronic voice file provides linguistic attributes for substantiation of voice-translated content consistent with a particular speaker's voice. Standardization of voice sounds and speech attributes in a digital format allows easy selection and application of one speaker's voice file, or that of another, to a text-to-speech translation. In addition, digital voice files of the present invention can be readily distributed and used by multiple text-to-speech translation devices. Once a voice file has been stored in a device, the voice file can then be used on demand and without being retransmitted with each set of content to be translated.

Voice files, or fonts, in such embodiments operate in a manner similar to sound recordings using a Musical Instrument Digital Interface (MIDI) format. In a MIDI system, a single, separate musical sound is assigned a number. As an example, a MIDI sound file for a violin includes all the numbers for notes of the violin. Selecting the violin file causes a piece of music to be controlled by the number sequences in the violin file, and the music is played utilizing the separate digital recordings of a violin from the violin file, thereby creating a violin audio. To play the same music piece by some other instrument, the MIDI file, and number sequences, for that instrument is selected. Similarly, translation of text to speech can be easily changed from one voice file to another.

Sequential number voice files in embodiments of the present invention can be stored and transmitted using various formats and/or standards. A voice file can be stored in an ASCII (American Standard Code for Information Interchange) matrix or chart. As described above, a sequential number file can be stored as a matrix with 256 locations, known as a "font." Another example of a format in which voice files can be stored is the "unicode" standard, a data storage means similar to a font but having exponentially higher storage capacity. Storage of voice files using a "unicode" standard allows storage, for example, of attributes for multiple languages in one file. Accordingly, a single voice file could comprise different ways to express a voice and/or use a voice file with different types of voice production devices.

One aspect of the present invention is correlation (30) of distinct sounds in speech samples with audio representations. Phonemes are one such example of audio representations. When the voice file of a known speaker is applied (80) to a text, phonemes in the text are translated to corresponding phonemes representing sounds in the selected speaker's voice such that the translation emulates the speaker's voice.

FIG. 4 illustrates an example of translation of text using phonemes in a voice file. Embodiments of the voice file for the voice of a specific known speaker include all of the standardized phonemes as recorded by that speaker. In the example in FIG. 4, the voice file for known speaker X (100) includes recorded speech samples comprising the 39 standard phonemes in the Carnegie Mellon University (CMU) Pronouncing Dictionary listed in the table below:

| Alpha Symbol | Sample Word | Phoneme |
|---|---|---|
| AA | odd | AA D |
| AE | at | AE T |
| AH | hut | HH AH T |
| AO | ought | AO T |
| AW | cow | K AW |
| AY | hide | HH AY D |
| B | be | B IY |
| CH | cheese | CH IY Z |
| D | dee | D IY |
| DH | thee | DH IY |
| EH | Ed | EH D |
| ER | hurt | HH ER T |
| EY | ate | EY T |
| F | fee | F IY |
| G | green | G R IY N |
| HH | he | HH IY |
| IH | it | IH T |
| IY | eat | IY T |

-continued

| Alpha Symbol | Sample Word | Phoneme |
|---|---|---|
| JH | gee | JH IY |
| K | key | K IY |
| L | lee | L IY |
| M | me | M IY |
| N | knee | N IY |
| NG | ping | P IH NG |
| OW | oat | OW T |
| OY | toy | T OY |
| P | pee | P IY |
| R | read | R IY D |
| S | sea | S IY |
| SH | she | SH IY |
| T | tea | T IY |
| TH | theta | TH EY T AH |
| UH | hood | HH UH D |
| UW | two | T UW |
| V | vee | V IY |
| W | we | W IY |
| Y | yield | Y IY L D |
| Z | zee | Z IY |
| ZH | seizure | S IY ZH ER |

Sounds in sample words 103 recorded by known speaker X (100) are correlated with phonemes 112, 122, 132. The textual sequence 140, "You are one lucky cricket" (from the Disney movie "Mulan"), is converted to its constituent phoneme string using the CMU Phoneme Dictionary. Accordingly, the phoneme translation 142 of text 140 "You are one lucky cricket" is: Y UW. AA R. W AH N. L AH K IY. K R IH K AH T. When the voice file 101 is applied, the phoneme pronunciations 112, 122, 132 as recorded in the speech samples by known speaker X (100) are used to translate the text to sound like the voice of known speaker X (100).

In embodiments of the present invention, a voice file includes speech samples comprising sample words. Because sounds from speech samples are correlated with standardized phonemes, the need for more extensive speech sample recordings is significantly decreased. The CMU Pronouncing Dictionary is one example of a source of sample words and standardized phonemes for use in recording speech samples and creating a voice file. In other embodiments, other dictionaries including different phonemes are used. Speech samples using application-specific dictionaries and/or user-defined dictionaries can also be recorded to support translation of words unique to a particular application.

Recordings from such standardized sources provide representative samples of a speaker's natural intonations, inflections, and accent. Additional speech samples can also be recorded to gather samples of the speaker when various phonemes are being emphasized and using various speeds, rhythms, and pauses. Other samples can be recorded for emphasis, including high and low pitched voicings, as well as to capture voice-modulating emotions such as joy and anger. In embodiments using voice files created with speech samples correlated with standardized phonemes, most words in a text can be translated to speech that sounds like the natural voice of the speaker whose voice file is used. A such, the present invention provides for more natural and intelligible translations using recognizable voices that will facilitate listening with greater clarity and for longer periods without fatigue or becoming annoyed.

In other embodiments, voice files of animate speakers are modified. For example, voice files of different speakers can be combined, or "morphed," to create new, yet naturally-sounding voice files. Such embodiments have applications including movies, in which inanimate characters can be given the voice of a known voice talent, or a modified but natural voice. In other embodiments, voice files of different known speakers are combined in a translation to create a "morphed" translation of text to speech, the translation having attributes of each speaker. For example, a text including a one author quoting another author could be translated using the voice files of both authors such that the primary author's voice file is use to translate that author's text and the quoted author's voice file is used to translate the quotation from that author.

In the present invention, voice files can be applied to a translation in conventional text-to-speech (TTS) translation devices, or engines. TTS engines are generally implemented in software using standard audio equipment. Conventional TTS systems are concatenative systems, which arrange strings of characters into a connected list, and typically include linguistic analysis, prosodic modeling, and speech synthesis. Linguistic analysis includes computing linguistic representations, such as phonetic symbols, from written text. These analyses may include analyzing syntax, expanding digit sequences into words, expanding abbreviations into words, and recognizing ends of sentences. Prosodic modeling refers to a system of changing prose into metrical or verse form. Speech synthesis transforms a given linguistic representation, such as a chain of phonetic symbols, enhanced by information on phrasing, intonation, and stress, into artificial, machine-generated speech by means of an appropriate synthesis method. Conventional TTS systems often use statistical methods to predict phrasing, word accentuation, and sentence intonation and duration based on pre-programmed weighting of expected, or preferred, speech parameters. Speech synthesis methods include matching text with an inventory of acoustic elements, such as dictionary-based pronunciations, concatenating textual segments into speech, and adding predicted, parameter-based speech attributes.

Embodiments of the present invention include selecting a voice file from among a plurality of voice files available to apply to a translation of text to speech. For example, in FIG. 5, voice files of a number of known speakers are stored for selective use in TTS translation device 500. Individualized voice files 101, 201, 301, and 401 comprising speech samples, correlated phonemes, and identifiers of known speakers X (100), Y (200), Z (300), and n (400), respectively, are stored in TTS device 500. One of the stored voice files 301 for known speaker Z (300) is selected (70) from among the available voice files. Selected voice file 301 is applied (80) to a translation 90 of text so that the resulting speech is voiced according to the voice file 301, and the voice, of known speaker Z (300).

Such an embodiment as illustrated in FIG. 5 has many applications, including in the entertainment industry. For example, speech samples of actors can be recorded and associated with phonemes to create a unique number sequence voice file for each actor. To experiment with the type of voices and the voices of particular actors that would be most appropriate for parts in a screen play, for example, text of the play could be translated into speech, or read, by voice files of selected actors stored in a TTS device. Thus, the screen play text could be read using voice files of different known voices, to determine a preferred voice, and actor, for a part in the production.

Text-to-speech conversions using voice files in embodiments of the present invention are useful in a wide range of applications. Once a voice file has been stored in a TTS device, the voice file can be used on demand. As shown in FIG. 5, a user can simply select a stored voice file from among those available for use in a particular situation. In addition, digital voice files of the present invention can be readily distributed and used in multiple TTS translation devices. In another aspect of the present invention, when a desired voice file is already resident in a device, it is not necessary to transmit the voice file along with a text to be translated with that particular voice file.

FIG. 6 illustrates distribution of voice files to multiple TTS devices for use in a variety of applications. In FIG. 6, voice files 101, 201, 301, and 401 comprising speech samples, correlated phonemes, and identifiers of known speakers X (100), Y (200), Z (300), and n (400), respectively, are stored in TTS device 500. Voice files 101, 201, 301, and 401 can be distributed to TTS device 510 for translating content on a computer network, such as the Internet, to speech in the voices of known speakers X (100), Y (200), Z (300), and n (400), respectively.

Specific voice files can be associated with specific content on a computer network, including the Internet, or other wide area network, local area networks, and company-based "Intranets." Content for text-to-speech translation can be accessed using a personal computer, a laptop computer, personal digital assistant, via a telecommunication system, such as with a wireless telephone, and other digital devices. For example, a family member's voice file can be associated with electronic mail messages from that particular family member so that when an electronic mail message from that family member is opened, the message content is translated, or read, in the family member's voice. Content transmitted over a computer network, such as XML and HTML-formatted transmissions, can be labeled with descriptive tags that associate those transmissions with selected voice files. As an example, a computer user can tag news or stock reports received over a computer network with associations to a voice file of a favorite newscaster or of their stockbroker. When a tagged transmission is received, the transmitted content is read in the voice represented by the associated voice file. As another example, textual content on a corporate intranet can be associated with, and translated to speech by, the voice file of the division head posting the content, of the company president, or any other selected voice file.

Another example of translating computer network content using voice files of the present invention involves "chat rooms" on the internet. Voice files of selected speakers, including a chat room participant's own voice file, can be used to translate textual content transmitted in a chat room conversation into speech in the voice represented by the selected voice file.

Embodiments of voice files of the present invention can be used with stand-alone computer applications. For example, computer programs can include voice file editors. Voice file editing can be used, for instance, to convert voice files to different languages for use in different countries.

In addition to applications related to translating content from a computer network, methods and systems of the present invention are applicable to speech translated from text communicated over a telecommunications system. Referring to FIG. 6, voice files 101, 201, 301, and 401 can be distributed to TTS device 520 for translating text communicated over a telecommunications system to speech in the voices of known speakers X (100), Y (200), Z (300), and n (400), respectively. For example, electronic mail messages accessed by telephone can be translated from text to speech using voice files of selected known speakers. Also, embodiments of the present invention can be used to create voice mail messages in a selected voice.

As shown in FIG. 6, voice files 101, 201, 301, and 401 can be distributed to TTS device 530 for translating text used in business communications to speech in the voices of known speakers X (100), Y (200), Z (300), and n (400), respectively. For example, a business can record and store a voice file for a particular spokesperson, whose voice file is then used to translate a new announcement text into a spoken announcement in the voice of the spokesperson without requiring the spokesperson to read the new announcement. In other embodiments, a business selects a particular voice file, and voice, for its telephone menus, or different voice files, and voices, for different parts of its telephone menu. The menu can be readily changed by preparing a new text and translating the text to speech with a selected voice file. In still other embodiments, automated customer service calls are translated from text to speech using selected voice files, depending on the type of call.

Embodiments of the present invention have many other useful applications. Embodiments can be used in a variety of computing platforms, ranging from computer network servers to handheld devices, including wireless telephones and personal digital assistants (PDAs). Customized text-to-speech translations using methods and systems of the present invention can be utilized in any situation involving automated voice interfaces, devices, and systems. Such customized text-to-speech translations are particularly useful in radio and television advertising, in automobile computer systems providing driving directions, in educational programs such as teaching children to read and teaching people new languages, for books on tape, for speech service providers, in location-based services, and with video games.

Although the present invention has been described with reference to particular embodiments, it should be recognized that these embodiments are merely illustrative of the principles of the present invention. Those of ordinary skill in the art will appreciate that a method and system for customizing voice translations of text to speech of the present invention may be constructed and implemented in other ways and embodiments. Accordingly, the description herein should not be read as limiting the present invention, as other embodiments also fall within the scope of the present invention.

What is claimed is:

1. A method, comprising:

receiving text content for translation to speech;

correlating the text content to textual phrases of multiple words;

converting each textual phrase into a corresponding string of phonemes;

retrieving a phoneme identifier that uniquely represents each phoneme in the string of phonemes;

concatenating each phoneme identifier of each phoneme in the string of phonemes to produce a sequence of phoneme identifiers with each phoneme identifier separated by a comma;

creating a corresponding sequence of phoneme identifiers for each string of phonemes that corresponds to each textual phase in the text content;

concatenating each sequence of phoneme identifiers and separating each sequence of phone identifiers by a semicolon;

accessing a voice file storing recorded phrases in a speaker's voice;

mapping each sequence of phoneme identifiers to a corresponding recorded phrase found in the speaker's voice file;

retrieving the recorded phrase from the voice file that corresponds to each sequence of phoneme identifiers from the text content;

concatenating together the recorded phrases from the speaker's voice file to form a sequence of the recorded phrases as a speech translation of the text content; and outputting the speech translation as a translation of the text content to speech.

2. The method of claim 1, wherein the phoneme identifier uniquely represents a phone.

3. The method of claim 1, wherein the phoneme identifier uniquely represents a biphone.

4. The method of claim 1, wherein the phoneme identifier uniquely represents a triphone.

5. The method of claim 1, wherein the text content comprises content received from a computer network.

6. The method of claim 5, wherein the text content received from the computer network comprises an electronic mail message.

7. The method of claim 1, wherein the text content comprises text received from a telecommunications system.

8. The method of claim 1, further comprising selecting voice files when translating the text content to speech, wherein the translated speech is customized according to a selected voice file.

9. A text-to-speech translation voice customization system, comprising:

means for receiving text content for translation to speech;

means for correlating the text content to textual phrases of multiple words;

means for converting each textual phrase into a corresponding string of phonemes;

means for retrieving a phoneme identifier that uniquely represents each phoneme in the string of phonemes;

means for concatenating each phoneme identifier of each phoneme in the string of phonemes to produce a sequence of phoneme identifiers with each phoneme identifier separated by a comma;

means for creating a corresponding sequence of phoneme identifiers for each string of phonemes that corresponds to each textual phrase in the text content;

means for concatenating each sequence of phoneme identifiers and separating each sequence of phone identifiers by a semi-colon;

means for accessing a voice file storing recorded phrases in a speaker's voice;

means for mapping each sequence of phoneme identifiers to a corresponding recorded phrase in the speaker's voice file;

means for retrieving the recorded phrase from the voice file that corresponds to each sequence of phoneme identifiers;

means for concatenating together the recorded phases from the speaker's voice file to form a sequence of the recorded phrases as a speech translation of the text content; and means for outputting the speech translation as a translation of the text content to speech.

10. The system of claim 9, wherein the recorded phrases comprise digitally recorded speech samples.

11. The system of claim 9, wherein the recorded phrases comprise analog voice signals that are converted to digital samples and represent at least one of speech speed, emphasis, rhythm, pitch, pausing, and emotion of the speaker.

12. The system of claim 9, further comprising means for accessing a subset of the voice file sufficient to cause the textual sequence to be translated to speech using the associated voice file.

13. The system of claim 9, further comprising means for classifying the string of phonemes to standardized numbers.

14. The system of claim 13, wherein a standardized number uniquely represents at least one of a phone, a phoneme, a biphone, and a triphone.

15. The system of claim 9, further comprising means for applying a combination of different voice files to create a new voice file.

16. The system of claim 9, further comprising means for receiving the text content as content from a computer network.

17. The system of claim 16, wherein the text content comprises an electronic mail message.

18. The system of claim 9, further comprising means for receiving the text content as text from a telecommunications system.

19. The system of claim 9, further comprising means for selecting voice files when translating the text content to speech, wherein the translated speech is customized according to a selected voice file.

20. A storage medium on which is encoded instructions for performing a method of translating text to speech, the method comprising:

receiving text content for translation to speech;

correlating the text content to textual phrases of multiple words;

converting each textual phrase into a corresponding string of phonemes;

retrieving a phoneme identifier that uniquely represents each phoneme in the string of phonemes;

concatenating each phoneme identifier of each phoneme in the string of phonemes to produce a sequence of phoneme identifiers with each phoneme identifier separated by a comma;

creating a corresponding sequence of phoneme identifiers for each string of phonemes that corresponds to each textual phrase in the text content;

concatenating each sequence of phoneme identifiers and separating each sequence of phone identifiers by a semi-colon;

accessing a voice file storing recorded phrases in a speaker's voice;

mapping each sequence of phoneme identifiers to a corresponding recorded phrase in the speaker's voice file;

retrieving the recorded phrase from the voice file that corresponds to each sequence of phoneme identifiers;

concatenating together the recorded phrases from the speaker's voice file to form a sequence of the recorded phrases as a speech translation of the text content; and outputting the speech translation as a translation of the text content to speech.

21. The storage medium of claim 20, further comprising instructions for selecting voice files, such that the text content is translated using a selected voice file.

* * * * *